US005970729A

United States Patent [19]

Yamamoto et al.

[11] Patent Number: 5,970,729

[45] Date of Patent: Oct. 26, 1999

[54] COOLING APPARATUS

[75] Inventors: Masayuki Yamamoto; Takahiro Katoh; Kiyoo Amako, all of Tokyo, Japan

[73] Assignee: STS Corporation, Tokyo, Japan

[21] Appl. No.: 08/943,351

[22] Filed: Oct. 1, 1997

Related U.S. Application Data

[63] Continuation of application No. 08/607,957, Feb. 29, 1996, abandoned.

[30] Foreign Application Priority Data

Mar. 1, 1995 [JP] Japan ..... 7-065258

[51] Int. Cl.[6] ..... F28F 7/00; F25B 25/00

[52] U.S. Cl. ..... 62/178; 62/332; 165/80.4

[58] Field of Search ..... 62/178, 29, 185, 62/259, 2, 332; 165/80.4

[56] References Cited

U.S. PATENT DOCUMENTS

| | | | |
|---|---|---|---|
| 4,415,847 | 11/1983 | Galloway | 62/201 X |
| 4,567,733 | 2/1986 | Mecozzi | 62/332 X |
| 4,619,114 | 10/1986 | Wilson | 62/332 X |

FOREIGN PATENT DOCUMENTS

| | | |
|---|---|---|
| 61-84480 | 6/1986 | Japan . |
| 1-260274 | 10/1989 | Japan . |
| 3-5684 | 1/1991 | Japan . |
| 3-191274 | 8/1991 | Japan . |
| 5-126418 | 5/1993 | Japan . |

OTHER PUBLICATIONS

Office Action dated Mar. 18, 1997 from Japanese Application No. Hei 7–65258 and translation of the Office Action.

** Translation of Abstracts of 1–260274; 3–191274 and 5–126418.

*Primary Examiner*—William Wayner

*Attorney, Agent, or Firm*—Panitch Schawarze Jacobs & Nadel, P.C.

[57] ABSTRACT

A cooling apparatus used, for instance, for a laser which is low in the consumption of energy and can be made small in size. The cooling apparatus includes: an outside air - water heat exchanger (or outside air cooler 15) as a first cooler; a refrigerant - water heat exchanger (or refrigerating cooler 27) as a second cooler; an outside air temperature sensor (22) for detecting an outside air temperature; and a control section (5) which, according to an outside air temperature, selects a refrigerator-cooler joint use mode for operating both the outside air cooler (15) and the refrigerating cooler (27), or an outside air cooler single use mode for operating only the outside air cooler (15) with the refrigerating cooler (27) stopped.

38 Claims, 6 Drawing Sheets

COOLING APPARATUS

This application is a continuation of 08/607,957, filed Feb. 29, 1996 now abandoned.

BACKGROUND OF THE INVENTION a) Field of the Invention

This invention relates to an apparatus for cooling water which is used to cool, for instance, a laser oscillator (hereinafter referred to as "a cooling apparatus", when applicable), and more particularly to a cooling apparatus in which cooling the cooling water with outside air is effectively utilized to greatly decrease the consumption of electric power.

b) Description of the Prior Art

An Ar laser or YAG laser oscillator is very low in energy efficiency. The electric power applied thereto is converted into laser beam at a rate of 10 to 30% at best, and the remaining electric power of 70 to 90% is consumed as heat. In order to remove the heat, a cooling apparatus is provided for the laser oscillator; that is, cooling water is circulated between the laser oscillator and the cooling apparatus to absorb the heat thus generated.

As typical examples of the cooling apparatus of this type, there are available an air cooling system using a refrigerator circuit wherein heat exchange is effected between cooling water and air through refrigerant, and a water cooling system wherein heat exchange is effected between primary cooling water and secondary cooling water. The term "refrigerator" as used herein is intended to mean the refrigerator which operates on a cooling cycle of refrigerant compression, heat-radiation, and expansion.

In the air cooling system using the refrigerator circuit, heat exchange is effected between a refrigerant cooled by the refrigerator and a laser cooling water (or primary cooling water), to cool the cooling water.

In the water cooling apparatus, the laser cooling water (or primary cooling water) is cooled with well water or secondary cooling water which has been cooled in the cooling tower.

FIG. 4 is a diagram showing the arrangement of a laser cooling apparatus of air cooling system which uses a refrigerator circuit.

The cooling apparatus 510, as shown in FIG. 4, comprises a refrigerating cooler 27, and a circulating pump 53, to supply cooling water to a laser power source 505 and a laser oscillator 2 in a circulation mode.

The refrigerating cooler 27 of the cooling apparatus 510 shown in FIG. 4 comprises: a compressor 33 for compressing refrigerant; a condenser 39 for condensing the refrigerant thus compressed; an automatic expansion valve 29 for expanding the refrigerant thus condensed; and a refrigerant - water heat exchanger 31.

The refrigerant (such as CFC and HFC) compressed by the compressor 33 is supplied to the condenser 39, where it is condensed by cooling. The condenser 39 is provided with a fan 37 which is adapted to blow the condenser 39 from outside thereby to remove the heat of condensation therefrom. The fan 37 is driven by a fan motor 35. As a result, the condenser 39 outputs liquified refrigerant. The liquified refrigerant thus outputted is sent to a drier filter 521, where water content is removed from the refrigerant. The refrigerant thus processed is sent to the automatic expansion valve 29, where it is expanded and gasified while being throttled. In this operation, the refrigerant is decreased in temperature by gasifying latent heat.

The refrigerant thus processed is supplied to the refrigerant - water heat exchanger 31, where heat exchange is effected between the refrigerant and the laser cooling water; that is, the latter is decreased in temperature. The refrigerant is allowed to come out of the heat exchanger 31, and is then compressed by the compressor 33 again. Thus, the above-described cooling cycle is repeatedly carried out to cool the laser cooling water.

On the other hand, when the circulating cooling water returns from the laser through a return pipe 11 to the cooling unit 510, and enters the refrigerant - water heat exchanger 31, where it is cooled. The refrigerant thus cooled is pressurized by a circulating pump 53. The refrigerant thus pressurized is sent through a flow-rate adjusting valve 65, a pressure meter 515, a temperature sensor 513, a flow meter 511, and a supply pipe 67 to the laser power source 505 and the laser oscillator 2. The cooling water is partially supplied through a bypass pipe 517 to a filter 519, where dust or foreign matter is removed from the cooling water. Further in FIG. 4, reference numeral 509 designates a temperature sensor; and 507, a flow sensor.

With the cooling apparatus shown in FIG. 4, in general the temperature of the cooling water is adjusted as follows:

(1) In the case where the heat load on the laser side is constant (for instance a rated output of 18 kW):

The temperature of the cooling water can be substantially stably set by heat-insulating the piping with the heat load of the cooling apparatus taken into account.

(2) In the case where the heat load on the laser side varies, or heat input or output other than from the laser side more or less affects the temperature of the cooling water, or outside air temperature affects the input and output balance with the heat load:

(a) The refrigerating compressor is turned on and off to adjust the temperature of the cooling water.

(b) For instance, an inverter is used to control the speed of the condenser's fan.

(c) A hot gap bypass circuit (not shown in FIG. 4) is provided between the inlet of the condenser and the outlet of the temperature expansion valve, so that when the temperature of the cooling water becomes lower than the predetermined value, a hot gas pipe valve is opened to adjust the temperature of the cooling water.

The above-described cooling apparatus of refrigerator type suffers from the following problems:

(1) A lot of electric power is consumed because the refrigerator (the compressor, and so forth) must be operated at all times during the operation of the cooling apparatus (and accordingly the laser oscillator) .

(2) In the case where the cooling apparatus is installed inside the room, it is necessary to provide a cooling air conditioner or ducts to remove the heat discharged from the cooling apparatus.

(3) In the case of the cooling apparatus which requires a cooling capacity corresponding to a high thermal load (for instance more than 10 kW), an additional construction (such as the construction of a foundation of 10 to 15 cm for outdoor installation of the overweight cooling apparatus) is required, which increases the initial equipment investment.

(4) The cooling apparatus is great in weight, large in dimension, large in noise, and great in vibration. Hence, the installation of the cooling apparatus is permitted only in factories, industrial areas, non-dwelling areas, and so forth.

(5) The rotary machines such as the compressor, the fan, and the pump make large noises and vibrate greatly.

FIG. 5 is a diagram showing the arrangement of a cooling apparatus 601 of water cooling apparatus.

The cooling unit 601, as shown in FIG. 5, comprises a water—water heat exchanger 611 as a cooler. Secondary cooling water (external cooling water) is supplied through a pipe 613 and a filter 614 to the heat exchanger 611, where heat exchange is effected between the secondary cooling water and the laser cooling water (or primary cooling water) which flows through a pipe 609, so that the laser cooling water is cooled. Examples of the secondary cooling water are circulating cooling water which is cooled in a cooling tower by evaporation, or underground water, or running water.

On the other hand, the laser cooling water is sent from the laser (not shown) through a return pipe 11 to a cooling water tank 45 in the cooling unit 601. The tank 45 is to standardize the variation in temperature of the cooling water returning from the laser. The laser cooling water is supplied from the tank 45 through a filter 605 and a pump 53 to the pipes 607 and 609. As was described before, the pipe 609 enters the heat exchanger 611. The pipe 607 bypasses the heat exchanger 611.

The cooling apparatus 601 includes a temperature control valve 617, which is adapted to control the flow rate of cooling water flowing in the pipe 607 relative to the cooling water flowing in the pipe 609, to thereby control the temperature of the cooling water at the outlet of the temperature control valve 617. The temperature of the cooling water at the outlet of the temperature control valve 617 is detected with a temperature sensor 619, which outputs a temperature detection signal. In response to the temperature detection signal, the temperature control valve 617 is controlled in a feed-back mode. The cooling water thus temperature-controlled is supplied through a flow control valve 65 and a supply pipe 67 to the laser oscillator.

The above-described cooling apparatus of water-cooling type suffers from the following difficulties:

(1) The amount of power consumed by the cooling apparatus of water-cooling type is relatively small (about ¼ to 1/15 of the amount of power consumed by the cooling apparatus using the refrigerator circuit). However, the cooling apparatus uses a lot of running water, industrial water, or underground water as the secondary cooling water, so that it is considerably high in operating cost. On the other hand, sometimes during a dry season such as summer, the use of such water may be limited; that is, the operation of the laser may be limited.

(2) It is necessary to provide equipment (such as a cooling tower, a waste-water processing facility, pipes, and wells). If not available, they must be newly provided to operate the cooling apparatus; that is, in this case, too, the initial installation investment is relatively great (incidentally, in Japan, it takes at least 3,000,000 yen to dig a well).

SUMMARY OF THE INVENTION

Accordingly, an object of the invention is to provide a cooling apparatus for a laser device which is free from the above-described difficulties accompanying the above-mentioned cooling apparatuses, and which is low in power consumption and can be made small in size.

The foregoing object of the invention has been achieved by the provision of the following means:

The first means is a cooling apparatus which, according to a first aspect of the invention comprises:

an outside air - water heat exchanger (or outside air cooler) as a first cooler;

a refrigerant - water heat exchanger (or refrigerating cooler) as a second cooler;

an outside air temperature sensor for detecting an ambient temperature condition;

a control section which, according to the ambient temperature, chooses a refrigerator-cooler joint use mode for operating both the outside air cooler and the refrigerating cooler, or an outside air cooler single use mode for operating only the outside air cooler with the refrigerating cooler stopped.

The second means is a cooling apparatus which is adapted to cool circulating cooling water for cooling a laser medium gas, which, according to a second aspect of the invention, comprises:

a cooling water circulating pump;

an outside air cooler as a first cooler, including an outside air - water heat exchanger in which heat exchange is effected between outside air and cooling water, a fan for applying outside air to the heat exchanger, and a fan driving motor;

a refrigerating cooler as a second cooler, including a refrigerator having a cycle of refrigeration, and a refrigerant - water heat exchanger in which heat exchange is effected between a refrigerant cooled by the refrigerator and cooling water;

a cooling water tank provided on the side of the outlet of the second cooler;

an outside air temperature sensor for detecting an ambient temperature condition;

a control section which, according to the ambient temperature condition, chooses a refrigerator-cooler joint use mode for operating both the outside air cooler and the refrigerating cooler, or an outside air cooler single use mode for operating only the outside air cooler with the refrigerating cooler stopped.

For instance, in the case of an Ar gas laser for an optical molding device, the temperature of the cooling water returning from the laser (hereinafter referred to as "a return temperature", when applicable) is of the order of 50 to 60° C., and the temperature of the cooling water supplied to the laser (hereinafter referred to as "a supply temperature", when applicable) is of the order of 30° C. On the basis of these facts, the cooling water returning to the cooling apparatus is primarily cooled with an outside air cooler including an outside air - water heat exchanger (primary cooling), and thereafter it is secondarily cooled with a refrigerating cooler when necessary (secondary cooling), with results that the refrigerator can be miniaturized, and the power consumption is decreased. In the case when the outside air temperature is low (20° C. or lower) as in winter, the cooling water can be sufficiently cooled with the outside air cooler only. Hence, an outside air cooler single use mode for operating only the outside air cooler with the refrigerator stopped, or a refrigerator-cooler joint use mode for operating both the outside air cooler and the refrigerator is selectively effected, so that the power consumption is further decreased.

The term "cooling water" as used herein is intended to mean not only so-called "cooling water" but also refrigerant in liquid phase. In addition, the term "refrigerator" or "refrigerating cooler" as used herein is intended to include an artificial cooler (such as a cooler operated on the thermo-electric principle) which has no refrigerant refrigeration cycle when interpreted most broadly. An example of the cooler operated on the thermo-electric principle is a Peltier element.

With the cooling apparatus, there may be employed a variety of control methods for controlling the temperature of cooling water:

(1) First control method: The speed (rpm) of the fan of the outside air cooler is controlled.

(2) Second control method: The speed (rpm) of the compressor and that of the condenser in the refrigerator are controlled.

(3) Third control method: The fan of the outside air cooler, and the compressor and the fan of the condenser in the refrigerator are turned on and off according to the variation in temperature of the cooling water tank.

(4) Fourth control method: The cooling water relatively low in temperature which is passed through the heat exchanger, and the water relatively high in temperature which is not passed through the heat exchanger are mixed together by using a mixing-ratio-variable mixing valve, so that the temperature of the cooling water is adjusted (cf. FIG. 5).

The above-described third control method (3) is advantageous in that it is relatively simple; however, it is still disadvantageous in that the cooling water supply temperature is low in stability, and the compressor may be deteriorated soon because it is repeatedly turned on and off. The fourth control method (4) is advantageous in that the cooling water supply temperature is high in stability; however, it is also disadvantageous in that the fan, the heat exchanger, and the compressor must be great in capacity.

Hence, as for the invention, the single use of the first or second control method (1) or (2), or the joint use of the first and second control methods (1) and (2) is preferable. However, the use of the first control method is more preferable because the number of objects which must be controlled in speed (rpm) is only one. On the other hand, in order to decrease the power consumption, the joint use of the first and second control methods (1) and (2) is most suitable.

It is preferable that a threshold temperature (or mode change-over temperature) at which the refrigerating cooler is operated or stopped is set 20 to 27° C. if the cooling apparatus of the invention is employed under the conditions that the temperature of said cooling water is 45 to 65° C. at the inlet of said cooling apparatus, and 20 to 40° C. at the outlet of said cooling apparatus.

In designing the cooling apparatus of the invention, setting the mode change-over temperature is most important. If the mode change-over temperature is set high, then the outside air cooler must be large in size while the refrigerator and the cooler can be small in size. On the other hand, if the mode change-over temperature is set low, then the outside air cooler can be small in size while the refrigerating cooler must be large in size.

The initial cost, running cost (electric power cost) and size of the cooling apparatus depends on the mode change-over temperature thus selected as well as the variation in outside air temperature in the area where the apparatus is installed. As for the cooling apparatus of the invention, selection of the above-described temperature range is able to make the initial cost, running cost, and size most suitable in balance.

In the cooling apparatus of the invention, it is preferable that, when the outside air temperature is 40° C., the outside air cooler is responsible for 60 to 74% of the cooling effect of the cooling apparatus, while the refrigerating cooler is responsible for 40 to 26% of the cooling effect of the cooling apparatus.

This feature makes it possible to miniaturize the cooling apparatus. And, in areas which are similar in weather to Japan, the annual power consumption of the cooling apparatus can be minimized.

For the same reason, in the cooling apparatus of the invention, it is preferable that, when an outside air temperature is 40° C., a ratio of the power consumption of the compressor in the refrigerating cooler relative to the power consumption of the fan in the outside air cooler is 2.5 to 3.5.

Technical concept in selection of the performance of the cooling apparatus will be described later in detail.

As to the outside air temperature sensor, it is preferable to detect an ambient air temperature around the outside air cooler, but the outside air temperature sensor may be designed to detect other kinds of factors to thereby estimate an ambient temperature condition. For example, the outside air temperature sensor may be designed to detect a temperature of the cooling water to estimate the ambient temperature condition, and the control section chooses the refrigerator-cooler joint mode or the outside air cooler single use mode based on the detected temperature of the cooling water.

DETAILED DESCRIPTION OF THE PREFERRED EMBODIMENT

A preferred embodiment of the invention will be described.

Figure 1:
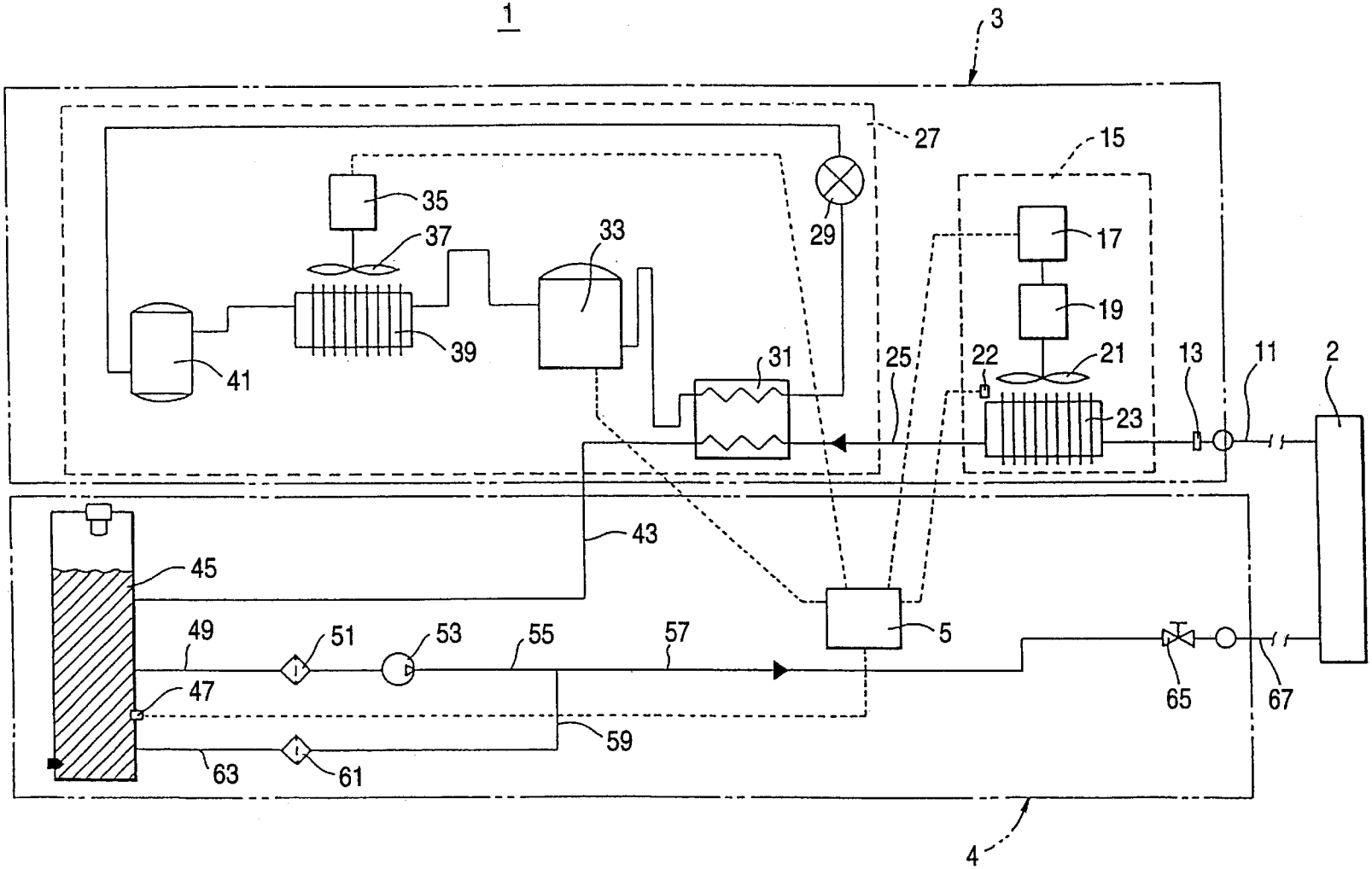
FIG. 1 is an explanatory diagram showing the arrangement of a laser cooling apparatus, which constitutes a preferred embodiment of the invention.

FIG. 1 is a diagram showing the arrangement of a cooling apparatus 1 for a laser device, which constitutes the embodiment of the invention.

As shown in FIG. 1, the cooling apparatus 1 is to supply circulating cooling water to a laser oscillator 2, comprising an outdoor unit 3 and an indoor unit 4.

The outdoor unit 3 comprises: a first cooler, namely, an outside air cooler 15; and a second cooler, namely, a refrigerating cooler 27.

The circulating cooling water returned through a return pipe 11 from the laser oscillator 2 flows into the outdoor unit 3. In the outdoor unit 3, first the temperature of the cooling water is read with a returned cooling water temperature sensor 13. In the case when the returned cooling water is abnormally high in temperature (for instance 70° or higher), the laser oscillator and the laser cooling apparatus are both automatically stopped.

Thereafter, the cooling water flows in an outside air - water heat exchanger 23 in the outside air cooler 15. In the embodiment, the heat exchanger 23 is of needle-point-holder-like thin pipe application direct cooling type. That is, in the heat exchanger, water is allowed to flow through in a number of copper pipes arranged like the needles of a needle point holder and curved, and the water flowing in the pipes is cooled by air-cooling the outside of the pipes.

Figure 6:
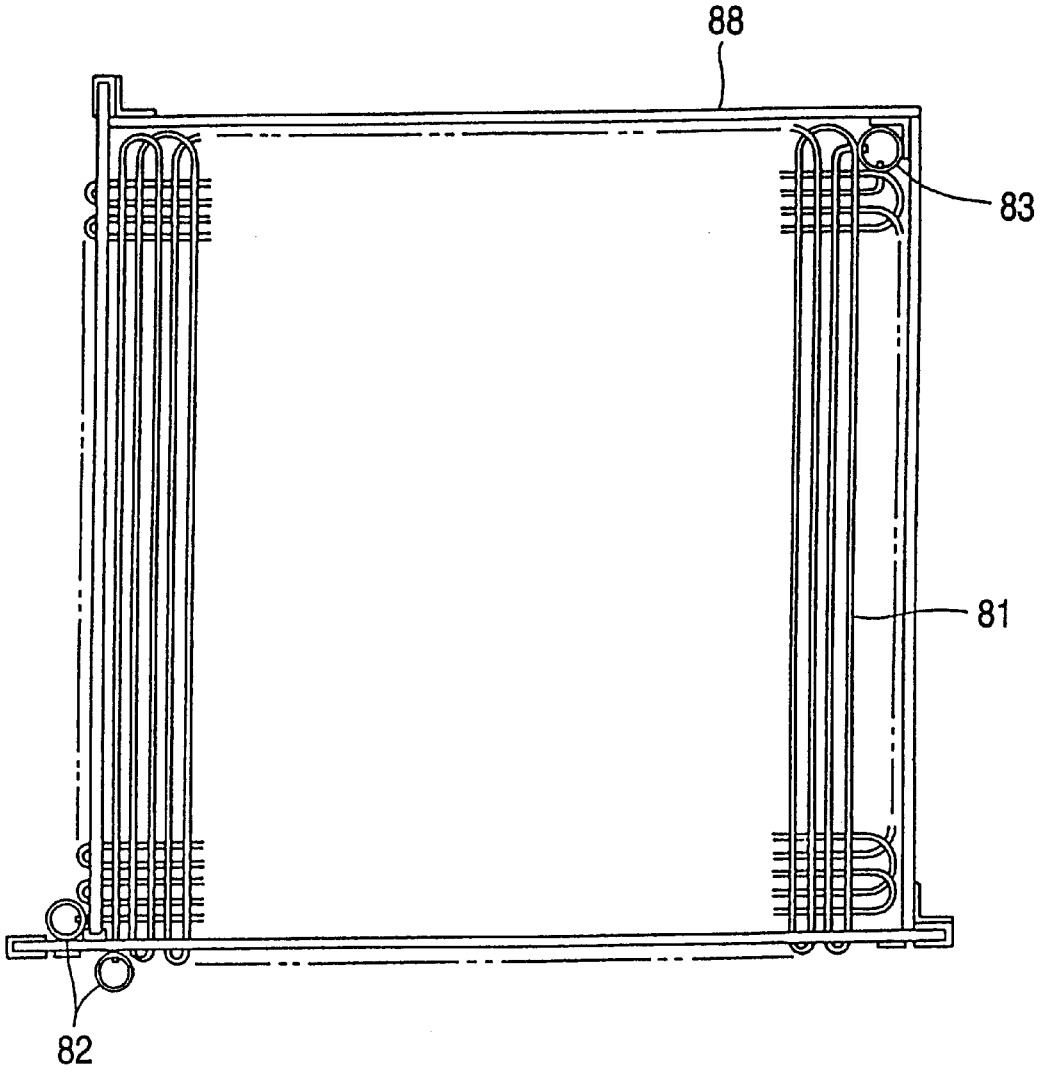
FIG. 6 is a fragmental plan view showing a heat exchanger employed in the cooling apparatus shown in FIG. 1.

FIG. 6 shows the heat exchanger of this type in detail which is employed in the cooling apparatus shown in FIG. 1. The heat exchanger comprises: a casing made up of side boards 88; and a number of thin cooling pipes (2.4 mm in inside diameter, and 3.2 mm in outside diameter) which are extended from inlet headers 82 to an outlet header 83.

In the embodiment, the laser circulating cooling water is clean water, and the outside air cooler is made of copper (oxygen free copper). In the case where the cooling water contains additives; for instance in the case of an ethylene glycol cooling water or NYBRINE group cooling water, a compact plate fin type heat exchanger made of aluminum is excellent in cost performance.

An electric fan 21 is provided above the heat exchanger 23 to blow outside air to the outer surfaces of the water pipes in the heat exchanger 23. The fan 21 is driven by an electric motor 19 with an inverter 17 as its power source. The inverter 17 is employed to control the temperature of the cooling water by rotation speed control, and to allow the fan to sufficiently make a current of air in the 50 Hz power zone as well as in the 60 Hz power zone. In addition, the inverter 17 may be employed as a frequency-controlled power source for a compressor 33 and an electric fan 37 provided for a condenser 39 in the refrigerating cooler 27, thereby to control the compressor maximum rated speed or the cooling water temperature.

The water flowing out of the outside air - water heat exchanger 23 enters through a pipe 25 into a refrigerant water heat exchanger 31 in the refrigerating cooler 27, where heat exchange is effected between the water and the refrigerant; that is, the water is further cooled. On the other hand, in the case where the outside air is at the mode change-over temperature or lower, and the operation mode is an outside air cooler single use mode, the water has been sufficiently cooled by the outside air cooler 15. Therefore, in the refrigerating cooler 27, the refrigerant - water heat exchanger 31 merely serves as a passageway in which the cooling water flows.

The refrigerating cooler 27 comprises the aforementioned compressor 33 for compressing refrigerant; the condenser 39 for condensing the refrigerant thus compressed; an automatic expansion valve 29 for expanding the refrigerant thus condensed; the aforementioned refrigerant - water heat exchanger 31 in which heat exchange is effected between refrigerant and cooling water.

The refrigerant (such as for instance CFC and HFC) compressed by the compressor 33 is supplied to the condenser 39, where it is condensed by cooling. The fan 37 is adapted to blow the condenser 39 from outside thereby to remove the heat of condensation therefrom. The compressor 33 and the fan 37 may be driven by a speed-variable motor with an inverter as its power source. The liquified refrigerant outputted by the condenser 39 is sent to the automatic expansion valve 29, where it is expanded and gasified while being throttled. In this operation, the refrigerant is decreased in temperature by gasifying latent heat.

The refrigerant thus processed is supplied to the refrigerant - water heat exchanger 31, where heat exchange is effected between the refrigerant and the laser cooling water; that is, the latter is decreased in temperature. The refrigerant, flowing out of the heat exchanger 31, is then compressed by the compressor 33 again. Thus, the above-described cooling cycle is repeatedly carried out to cool the cooling water.

The water flowing out of the refrigerant - water heat exchanger 31 is supplied through a pipe 43 into a cooling water tank in the indoor unit 4. The tank 45 is provided as a buffer for the variation in temperature of the cooling water. The temperature of the cooling water supplied to the laser oscillator is considerably severe (for instance 30±1° C.) with respect to its set value. Hence, in the laser cooling apparatus, the cooling water tank 45 serving as a buffer for the variation in temperature of the cooling water is provided, thereby to minimize the variation in temperature of the supplying cooling water which is, for instance, due to the variation in temperature of the returned cooling water. The tank 45 is provided with a cooling water tank temperature sensor 47, which detects the temperature of the cooling water in the tank 45, to output cooling water temperature controlling data (described later).

The water flowing out of the tank 45 is supplied through a pipe 49 and a strainer 51 into a pump 53, where it is pressurized. The water discharged from the pump 53 is supplied through a pipe 55, a pipe 57, a flow control valve 65, and a supply pipe 67 to the laser oscillator 2. The water from the pump 53 is partially run through a bypass pipe 59, an ion exchange filter 61, and a pipe 63, thus being returned into the tank 45 again. The ion exchange filter 61 is to remove metal ions (such as copper ions) which are formed in the circulating water during operation.

The cooling apparatus shown in FIG. 1 is made up of the outdoor unit 3 and the indoor unit 4, which comprises a variety of operating means. The indoor unit 4 includes the cooling water circulating pump 53, the cooling water tank 45, the ion exchange filter 61, the strainer (or filter) 51, the flow control valve 65, etc. Those operating means requires adjustment and maintenance, and therefore it is preferable that they are set, as an indoor unit, inside a room near the laser device.

Now, the temperature of the cooling water in the cooling apparatus shown in FIG. 1 will be described.

During the outside air cooler single use mode, the object to be controlled is the temperature of water contained in the cooling water tank, whereas the measure or variable for controlling is a number of revolution of the fan 21 provided in the outside air cooler. That is to say, in order to control the cooling water temperature with the apparatus of the invention, the controller 5 increases the output frequency of the inverter 17 to thereby increase the number of revolution of the fan 21 if the temperature of the water contained in the cooling water tank is higher than an aimed value, and decreases the output frequency of the inverter to thereby decrease the number of revolution of the fan 21 if the temperature of the water is lower than the aimed value.

The cooling apparatus of the invention is switched into the refrigerator-cooler joint use mode if the outside air temperature is higher than a predetermined value. That is to say, the outside air temperature is detected by the outside air temperature sensor 22 provided outside the heat exchanger 23 within the outside air cooler 15, and the controller 5, in response to a signal indicative of the detected temperature, stops the refrigerant cooler 27 if the detected temperature is lower than the mode switch or threshold temperature (for instance, 25° C.), and drives the refrigerant cooler 27 if it is higher than the mode switch temperature. In addition, to enable smooth switching operation, the hysteresis may be applied to the mode switch temperature, or the time-average processing for the outside temperature may be carried out.

To the cooling water temperature control during the refrigerator-cooler joint use mode, either of the following control method is applicable: That is, (A) the number of revolution of the fan 21 in the outside air cooler is controlled as similarly to the outside air cooler single use mode; (B) at least one of the compressor 33 and the condenser fan 37 in the refrigerant cooler is controlled in terms of the number of revolution; and (C) both of the above-mentioned methods (A) and (B) are carried out in combination. In view of the operation cost, the method of (C) is preferable.

In the preferred embodiment shown, the switching operation between the refrigerator-cooler joint use mode and the outside air cooler single use mode is carried out on the basis of the outside air temperature detected by the outside air temperature sensor 22. This arrangement that the switching operation is carried out on the basis of the outside air temperature whereas the fan 21, compressor 33 and/or the fan 37 are controlled depending on the temperature of the cooling water is advantageous in simplification of designing the cooling apparatus of the invention and in yearly-use of the apparatus. However, the invention should not be restricted thereto or thereby. For example, the switching operation in the cooling apparatus of the invention may be carried out on the basis of the temperature of the cooling water. In this case, in view of an advantage delivered from the switching operation being depending on the ambient temperature condition for yearly-use, it is preferable that the switching operation is carried out on the basis of the cooling water temperature detected immediately upstream position of the heat exchanger 23 since the cooling water temperature at this position is closely related to the ambient temperature condition (outside air temperature).

Next, the entire arrangement of a laser device to which the cooling apparatus shown in FIG. 1 is applicable will be explained.

Figure 2:
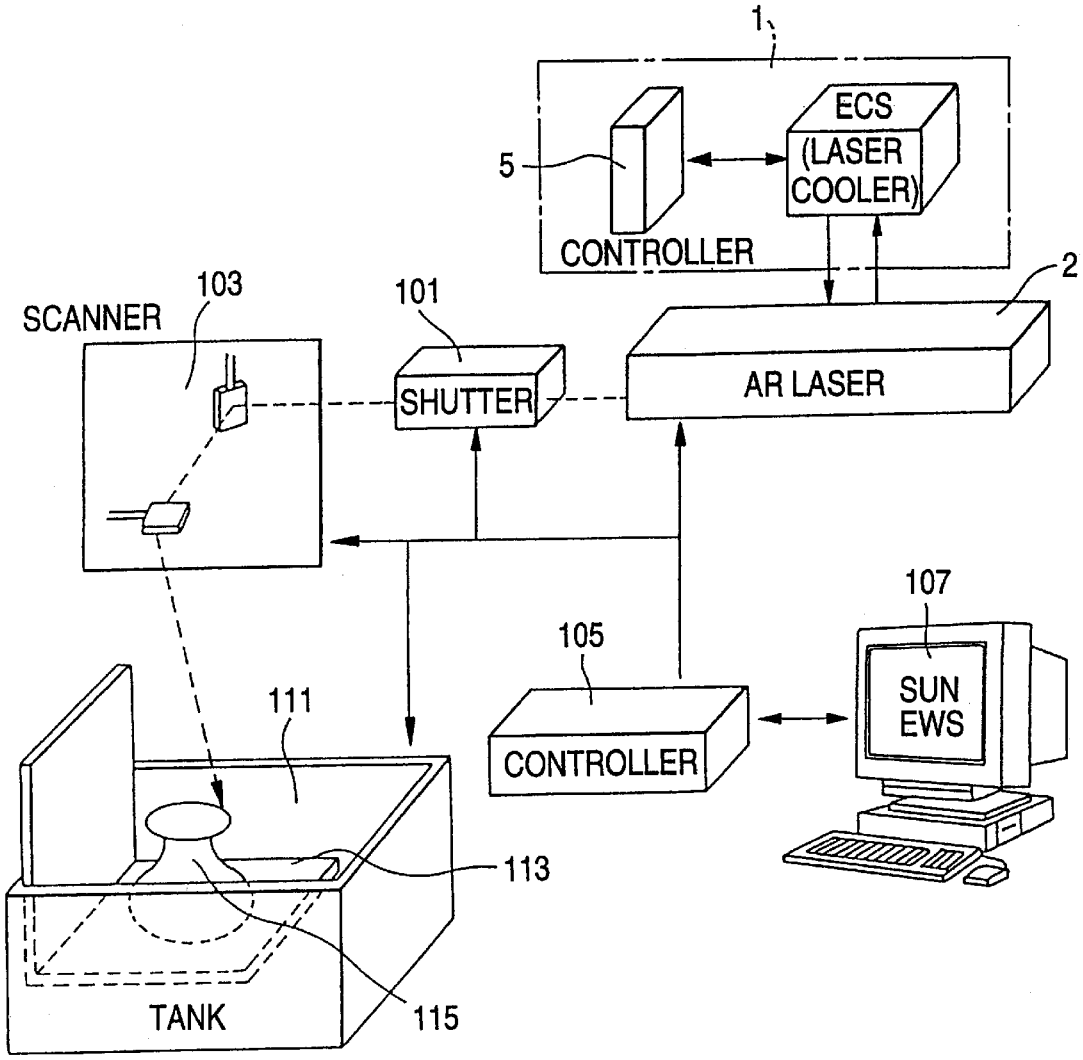
FIG. 2 is an explanatory diagram showing an optical molding system which employs an Ar laser which is cooled by the cooling apparatus of the invention.

FIG. 2 is an explanatory diagram showing the arrangement of an optical molding system which includes an Ar laser oscillator which is cooled by the cooling apparatus shown in FIG. 1.

The term "optical molding" as used herein is intended to means "a kind of molding process" in which a hardening light beam such as a laser beam is applied to an optically hardenable resin as required, to partially harden the resin, thereby to obtain an object having a desired configuration (hereinafter referred to as "an optically formed molding", when applicable).

In the optical molding system shown in FIG. 2, a laser beam produced by the Ar laser oscillator is applied through a shutter 101 and a scanner 103 to the optically hardenable resin in an optical molding tank 111, to form an optical molding. The shutter 101 is to turn on and off the laser beam, and the scanner 103 is to control the direction of the laser beam. A table 113 is provided in the molding tank 111. With the optical molding 115 on the table 113, the latter is gradually lowered so as to introduce a thin layer of optically hardenable resin on the upper surface of the optical molding 115. Thin layers of such optically hardenable resin thus introduced are optically hardened one after another, to complete the formation of the optical molding 115.

The optical molding system shown in FIG. 2 is controlled by a personal computer 107 with the aid of a controller 105. The shutter 101, the scanner 103, and the table 113 can be moved, for instance, according to CAD data stored in the personal computer 107, to form the optical molding 115 having a desired configuration.

The Ar laser oscillator 2 is cooled with the circulating cooling water which is supplied from the cooling apparatus 1.

The specific features of the laser oscillator employed the optical molding system shown in FIG. 2 reside in that, similarly as in laser oscillators employed in the field of medical equipment, in the field of precise measurement equipment or in the field of radar equipment, its output power is high, and stable for a long time, and high in precision.

Hence, the laser cooling apparatus must be durable and stable for a long time. Therefore, the cooling apparatus of two-stage type of the invention is suitable for cooling a laser oscillator for an optical molding system, because it is compact in size, simple in installation, and economical in the use of energy.

Now, a process for obtaining various operating data for the cooling apparatus of the invention will be described.

First, the air quantity $m_a$ of the fan is calculated as follows:

$$Q_0\ (\text{BTU/hr}) = C_{p.L}\ m_L\ (T_{L.in} - T_{L.out})$$

$$= C_{p.a}\ m_a\ (T_{a.out} - T_{a.in})$$

$$m_a = \rho_A\ V_A\ A = Q_0 / C_{Pa}\ (T_{a.out} - T_{a.in})$$

where $Q_0$ is the amount of heat generated by the laser oscillator; $C_{PL}$ is the isopiestic specific heat of the cooling water; $m_L$ is the flow rate of the cooling water; $T_{L.out}$ is the supply temperature of the cooling water; $T_{L.in}$ is the return temperature of the cooling water; $C_{p.a}$ is the isopiestic specific heat of the air; $m_a$ is the fan air quantity; $T_{a.out}$ is the temperature of air at the outlet of the heat exchanger; $T_{a.in}$ is the temperature of air at the inlet of the heat exchanger; $\rho_A$ is the air density; $V_A$ is the air speed of the heat exchanger; and A is the cross-sectional area of the flow-path of the heat exchanger.

After the air quantity of the fan has been determined, the size of the fan and the size of the heat exchanger are determined. In addition, the size of the refrigerator is selected. Thus, the whole size of the cooling apparatus is determined.

Figure 3:
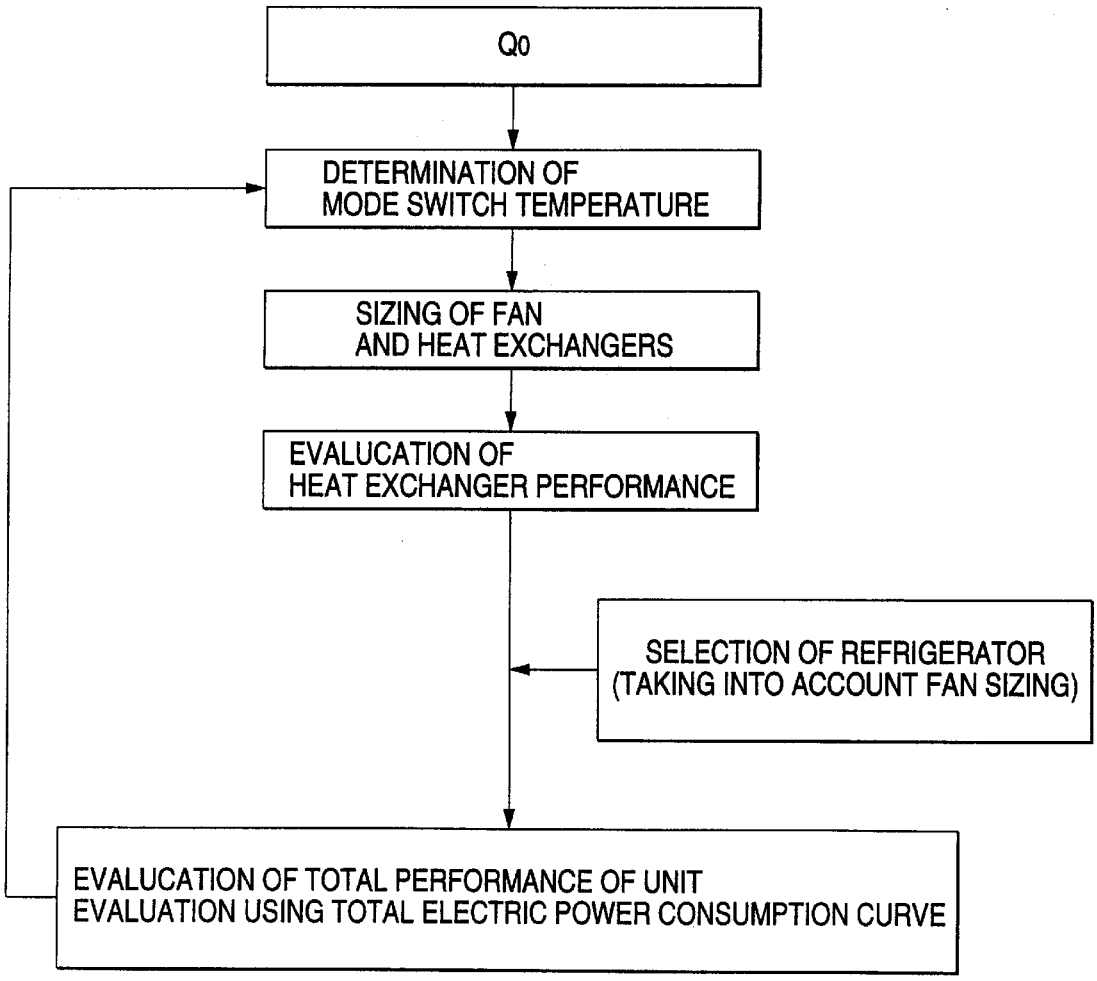
FIG. 3 is a flow chart indicating a simulation flow for optimization of the mode change-over temperature in the designing of the cooling apparatus of the invention.
Figure 4:
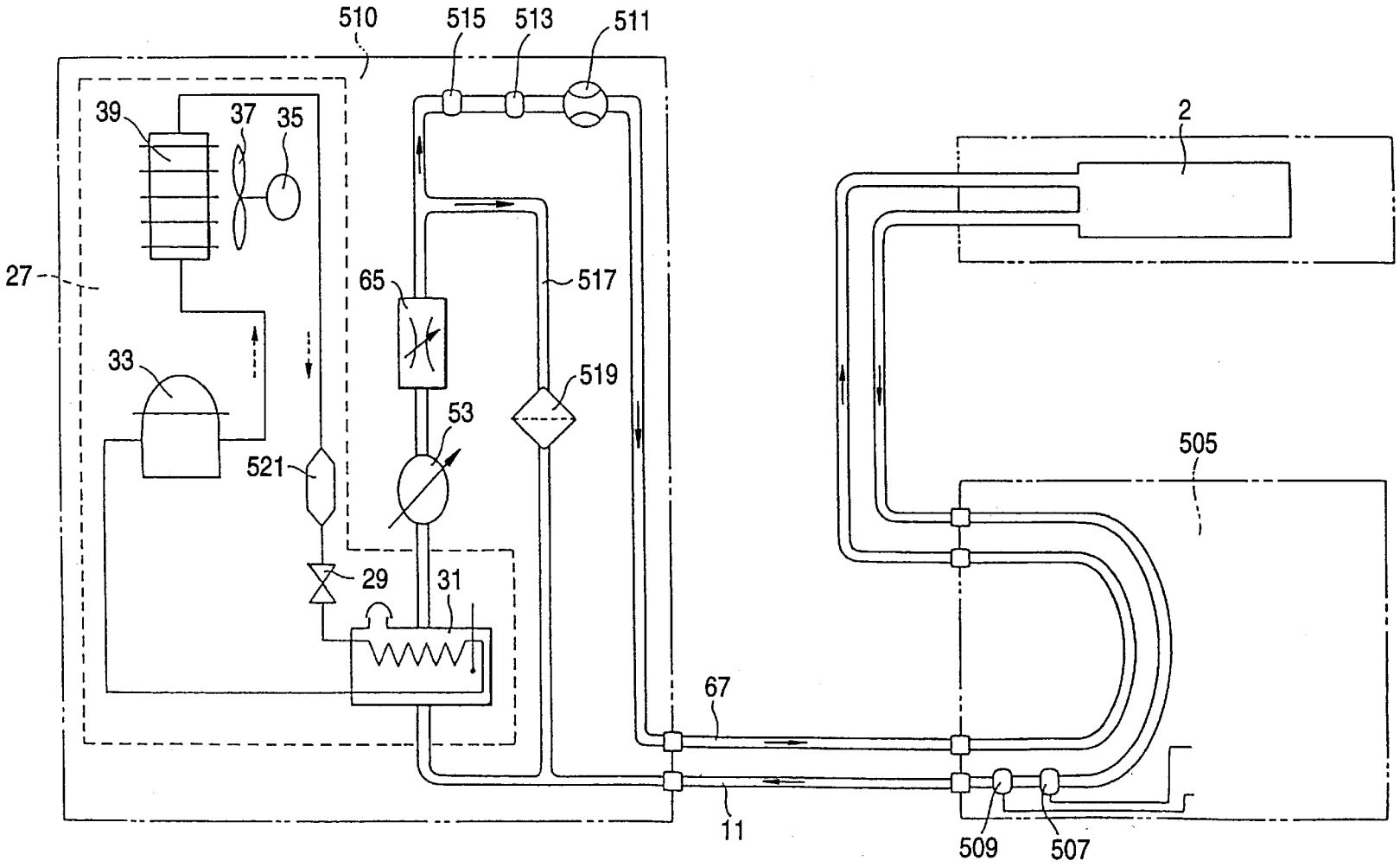
FIG. 4 is an explanatory diagram showing a conventional laser cooling apparatus of air cooling type which employs a refrigerator circuit.
Figure 5:
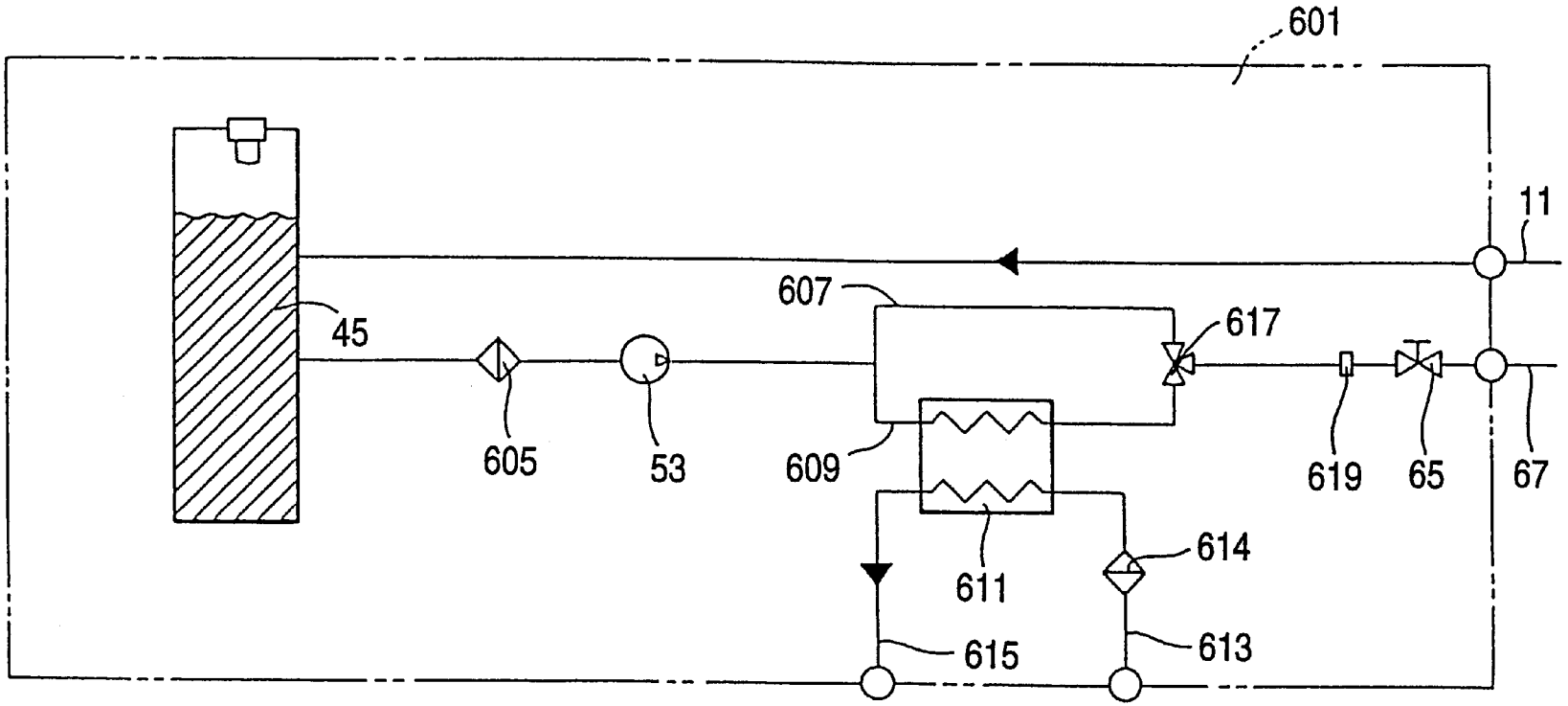
FIG. 5 is also an explanatory diagram showing the arrangement of a conventional laser cooling apparatus of water cooling type.

In the above-described various data determining operation, the size of the fan and the heat exchanger of the outside air cooler is determined depending on the maximally allowable temperature (° C.) at the inlet of the outside air heat exchanger in the outside air cooler single use mode (i.e., the mode change-over temperature). Moreover, the size data of the refrigerator are determined which are required for complement of the cooling capacity of the outside air cooler. Hence, the above-described mode change-over temperature is changed several times to determine the data for the various operating units. And, simulation of the size and the consumption of energy of the operating units in various data patterns is run repeatedly, to optimize those data. FIG. 3 is a flow chart indicating a simulation flow for optimization of the mode change-over temperature in the designing of the cooling apparatus of the invention.

In the cooling apparatus of the invention, the combination performance of the fan and the heat exchanger of the outside cooler, and the performance (capacity) of the refrigerator of the above-described refrigerating cooler must satisfy the following conditions:

$Q_0 = Q_1$ (amount of heat exchanged by the outside air cooler) + $Q_2$ (amount of heat exchanged by the refrigerating cooler)

Water equivalent ratio: $R = (m_L\ C_{P,L})/(m_a\ C_{P,a})$

Heat movement unit: $NTU = (U_1\ A_1)/(m_L\ C_{P,L})$ $U_1$ : Outside air cooler's total heat transfer coefficient $1/D_1=1/h_o+b/kw+d_o/(h_i\ d_i)$ $h_o$: Thin pipe's outside heat transfer coefficient b: Thin pipe's wall thickness kw: Heat conductivity $h_i$: Thin pipe's inside heat transfer coefficient $d_o$: Thin pipe's outside diameter $d_i$: Thin pipe's inside diameter $A_1$: Thin pipe's heat conducting area $$R=f(\epsilon, NTU)=(T_{L,in}-T_{L,out})/(T_{L,in}-T_{a,in})$$

$\epsilon$: Outside air cooler temperature efficiency

R is the function of $\epsilon$ and NTU, and therefore it is univocally determined when $\epsilon$ and NUT are determined. In the invention, $C \geqq 0.75$ The air quantity required for the fan of the outside air cooler is determined from the following equation:

$$m_a=(m_L\ C_{P,L})/(R\ C_{P,a})$$

On the other hand, the mode change-over temperature $T_{as}$ (that is, the maximally allowable temperature at the inlet of the heat exchanger of the outside air cooler in the signal outside air cooler mode) is as follows:

$$T_{as}=T_{L,m}-(T_{L,in}-T_{L,out})/\epsilon\ (\epsilon \geqq 0.75)$$

Hence, the static pressure condition of the outside air cooler required according to the fan performance curve (air quantity vs static pressure), and the mode change-over temperature are evaluated. And with those data taken into account together with the above-described design parameters, the designing of the outside air cooler is accomplished. In this connection, according to the results of experience, the size of the fan selected should be taken into consideration for determination of the size of the outside air cooler.

Thus, the refrigerator capacity $Q_2$ can be evaluated from the following:

$$Q_2=Q_0-Q_1$$

at $T_{a,\ in\ max}$ (outside air maximally allowable temperature)

It is preferable that, in order to meet the above-described conditions (or conditional expressions) 1) the combination performance of the fan and the heat exchanger of the outside air cooler, and 2) the refrigerating cooler capacity are evaluated with the mode change temperature $T_{as}$ as a main parameter, and the apparatus is suitably balanced in sizing (the trade-off of the total evaluation in performance). That is, in this case, the apparatus may be operated most economically in the consumption of electric power (being most suitable in the running cost).

The dimensions, the power consumption, etc. of the cooling apparatus having the following data were examined:

A device to be cooled: An Ar laser oscillator for an optical molding system, rated output of 18 kW Cooling water: Supplied at a temperature of 30 to 33±1° C., and returned at a temperature of 57 to 60° C. The flow rate was 9.5 liters/minute.

Outside air temperature: −10 to +40° C.

As a result of the examination, the following data were obtained:

Outside air cooler:

Fan air quantity—50 to 60 $m^3$/min Fan motor capacity—0.45 to 0.75 KW

Refrigerating cooler: Nominal capacity—1.5 KW

Hence, the apparatus was dimensioned as follows: (1) In the case where it was of the type that it is integral with the outdoor unit (with only the controller held indoors), 0.903×0.88×1.01 m, and a volume of 0.83 $m^3$. (2) In the case where the apparatus had the indoor unit and the outdoor unit, 0.93×0.80×1.01 m, and a volume of 0.75 $m^3$. Those values are 30 to 60% of the volume (1.50 to 12.50 $m^3$) of the conventional cooling apparatus of air cooling type. The annual average power consumption of the apparatus corresponded to an input power of 2.5 kW, being decreased to 30 to 40% of that of the conventional cooling apparatus of air cooling type, and 15 to 30% of that of the conventional cooling apparatus of water cooling type.

As is apparent from the above description, the cooling apparatus has the following effects or merits:

(1) The cooling apparatus of the invention is much less in power consumption than a cooling apparatus (A) in which the refrigerator is operated at all times, and than a cooling apparatus (B) of water cooling type that the primary cooling water is cooled with well water or the secondary cooling water which has been cooled by the cooling tower.

(2) The cooling apparatus of the invention, unlike the cooling apparatus of water cooling type, dispenses with the installation of large facilities such as a cooling tower, waste water processing facility, and well.

(3) For the cooling apparatus, the utility which is necessary at all times is only electricity. Hence, it can be installed with ease, and it can be operated even in the dry season such as summer.

(4) The cooling apparatus is made up of the indoor unit, and the outdoor unit. Hence, all equipment, such as a filter (or strainer), ion exchange filter, and cooling water tank which is rather troublesome in maintenance work can be provided inside the room.

(5) In the case where the cooling apparatus is of the type that it is integral with the outdoor unit, or in the case where the apparatus includes the indoor unit and the outdoor unit, it is relatively light in weight (for instance the cooling apparatus which is 18 kw in cooling capacity is about 250 kg). Hence, the cooling apparatus of the invention can be installed merely by simply strengthening the ground. In addition, it may be of caster type, and therefore it is unnecessary to make its foundation as high as 10 to 15 cm (required for the conventional cooling apparatus).

In addition, although the cooling apparatus of the invention has been explained along a case that it is applied so as to cool the laser oscillator, the invention can be applied to cool other kinds of devices. For instance, the invention is particularly applicable to a device that uses a liquified cooling medium for removing a large amount of heat generating concentrically or locally, a device that is required to be temperature-controlled with high accuracy, a device that is required to be cooled with water but is necessarily installed in a dry condition area, or the like, such as a machining center and a supercomputer.

What is claimed is:

1. A cooling apparatus having a cooling capacity comprising:

an air cooler serving as a primary cooler for cooling a fluid;

a refrigerating cooler serving as a secondary cooler fluidly connected with said air cooler for auxiliary cooling of the fluid;

a temperature sensor for detecting an ambient temperature condition; and a control section for selecting one of a joint use mode wherein both said air cooler and said refrigerating cooler are operated, and a single use mode wherein only said air cooler is operated with said refrigerating cooler stopped, according to said ambient temperature condition detected by said temperature sensor, the primary air cooler continually providing 60% to 100% of the cooling capacity of the apparatus for ambient temperatures up to 40° C.

2. A cooling apparatus as claimed in claim 1, further comprising:

a cooling water circulating pump for pressurizing and circulating cooling water; and a cooling water tank downstream of said refrigerating cooler; and wherein:

said air cooler includes an air-water heat exchanger in which heat exchange is effected between an ambient air and said cooling water, a fan for applying said ambient air to said heat exchanger, and a fan driving motor for driving said fan; and said refrigerating cooler includes a refrigerator forming a cycle of refrigeration, and a refrigerant-water heat exchanger in which heat exchange is effected between a refrigerant cooled by said refrigerator and said cooling water, said refrigerant-water heat exchanger being located between said air-water heat exchanger and said water tank.

3. A cooling apparatus as claimed in claim 2, wherein the temperature of said cooling water is 45 to 65° C. at an inlet of said cooling apparatus, and 20 to 40° C. at an outlet of said cooling apparatus, and a threshold temperature at which said refrigerating cooler is operated or stopped is 20 to 27° C.

4. A cooling apparatus as claimed in claim 2, wherein when an outside air temperature is 40° C., a power consumption ratio of a compressor provided in said refrigerating cooler relative to said fan of said air cooler is set 2 to 3.5.

5. A cooling apparatus as claimed in claim 2, wherein said temperature sensor detects an ambient temperature of air presented around said air-water heat exchanger.

6. A cooling apparatus as claimed in claim 1, wherein when the ambient air temperature is 40° C., said air cooler shares 60 to 74% of the entire cooling effect of said cooling apparatus, while said refrigerating cooler shares 40 to 26% of the entire cooling effect of said cooling apparatus.

7. A cooling apparatus as claimed in claim 1 wherein said refrigerating cooler is fluidly connected in series with said air cooler.

8. A cooling apparatus having a cooling capacity adapted to cool circulating cooling water for cooling a laser medium gas, said apparatus comprising:

a cooling water circulating pump;

an air cooler including an air-water heat exchanger in which heat exchange is effected between an ambient air and said cooling water, a fan for applying the ambient air to said heat exchanger, and a fan driving motor, the air cooler acting as a primary cooler;

a refrigerating cooler provided downstream of said air cooler, said refrigerating cooler including a refrigerator forming a cycle or refrigeration, and a refrigerant-water heat exchanger in which heat exchange is effected between a refrigerant cooled by said refrigerator and said cooling water, the refrigerant-water heat exchanger being fluidly connected in series with the air-water heat exchanger, the refrigerating cooler acting as a secondary cooler;

a cooling water tank provided downstream of said refrigerating cooler;

a temperature sensor for detecting an ambient air temperature;

a control section for selecting one of a joint use mode wherein both said air cooler and said refrigerating cooler are operated, and a single use mode wherein only said air cooler is operated with said refrigerating cooler stopped, according to said air temperature detected by said temperature sensor.

9. A cooling apparatus as claimed in claim 8, wherein when the ambient air temperature is 40° C., said air cooler shares 60 to 74% of the entire cooling effect of said cooling apparatus, while said refrigerating cooler shares 40 to 26% of the entire cooling effect of said cooling apparatus.

10. A cooling apparatus as claimed in claim 8, wherein when an outside air temperature is 40° C., a power consumption ratio of a compressor provided in said refrigerating cooler relative to said fan of said air cooler is set 2 to 3.5.

11. A cooling apparatus as claimed in claim 8, wherein the temperature of said cooling water is 45 to 65° C. at the inlet of said cooling apparatus, and 20 to 40° C. at the outlet of said cooling apparatus, and a threshold temperature at which said refrigerating cooler is operated or stopped is 20 to 27° C.

12. A cooling apparatus as claimed in claim 8 wherein the air cooler continually provides 60% to 100% of the cooling capacity of the apparatus for ambient temperatures up to 40° C.

13. A cooling apparatus as claimed in claim 8, wherein said laser is used in an optical molding system.

14. A cooling apparatus comprising:

an air cooler serving as a first cooler, said air cooler including an air-water heat exchanger in which heat exchange is effected between ambient air and cooling water, a fan for applying said ambient air to said heat exchanger, and a fan driving motor for driving said fan;

a refrigerating cooler serving as a second cooler;

a temperature sensor for detecting an ambient temperature condition;

a control section for selecting one of a joint use mode wherein both said air cooler and said refrigerating cooler are operated, and a single use mode wherein only said air cooler is operated with said refrigerating cooler stopped, according to said ambient temperature condition detected by said temperature sensor;

a cooling water circulating pump for pressurizing and circulating the cooling water;

a cooling water tank downstream of said refrigerating cooler;

speed changing means for changing speed of said fan driving motor provided in said air cooler;

a cooling water temperature sensor for detecting temperature of said cooling water contained in said cooling water tank; and a second control section for controlling said speed changing means in response to the temperature detected by said cooling water temperature sensor to adjust the speed of rotation of said fan to thereby maintain temperature of said cooling water at a predetermined value.

15. A cooling apparatus comprising:

an air cooler serving as a first cooler, said air cooler including an air-water heat exchanger in which heat exchange is effected between an ambient air and said cooling water, a fan for applying said ambient air to said heat exchanger, and a fan driving motor for driving said fan;

a refrigerating cooler serving as a second cooler;

a temperature sensor for detecting an ambient temperature condition;

a control section for selecting one of a joint use mode wherein both said air cooler and said refrigerating cooler are operated, and a single use mode wherein only said air cooler is operated with said refrigerating cooler stopped, according to said ambient temperature condition detected by said temperature sensor;

a cooling water circulating pump for pressurizing and circulating cooling water; and a cooling water tank downstream of said refrigerating cooler; and a cooling water processing element having at least one of a purifying filter, a strainer, and an ion exchange filter, wherein said cooling water circulating pump, said cooling water tank, said control section, and said cooling water processing element are set inside a room, while said air cooler and said refrigerating cooler are set outside said room.

16. A cooling apparatus adapted to cool circulating cooling water for cooling a laser medium gas, said apparatus comprising:

a cooling water circulating pump;

an air cooler including an air-water heat exchanger in which heat exchange is effected between ambient air and said cooling water, a fan for applying the ambient to said heat exchanger, and a fan driving motor;

a refrigerating cooler provided downstream of said air cooler, said refrigerating cooler including a refrigerator forming a cycle or refrigeration, and a refrigerant-water heat exchanger in which heat exchange is effected between a refrigerant cooled by said refrigerator and said cooling water;

a cooling water tank provided downstream of said refrigerating cooler;

a temperature sensor for detecting an ambient air temperature;

a control section for selecting one of a joint use mode wherein both said air cooler and said refrigerating cooler are operated, and a single use mode wherein only said air cooler is operated with said refrigerating cooler stopped, according to said air temperature detected by said temperature sensor;

speed changing means for changing speed of said fan driving motor in said air cooler;

a cooling water temperature sensor for detecting temperature of said cooling water contained in said cooling water tank; and a second control section for controlling said speed changing means in response to the temperature detected by said cooling water temperature sensor to adjust the speed of rotation of said fan to thereby maintain temperature of said cooling water at a predetermined value.

17. A cooling apparatus adapted to cool circulating cooling water for cooling a laser medium gas, said apparatus comprising:

a cooling water circulating pump;

an air cooler including an air-water heat exchanger in which heat exchange is effected between ambient air and said cooling water, a fan for applying the ambient to said heat exchanger, and a fan driving motor;

a refrigerating cooler provided downstream of said air cooler, said refrigerating cooler including a refrigerator forming a cycle or refrigeration, and a refrigerant-water heat exchanger in which heat exchange is effected between a refrigerant cooled by said refrigerator and said cooling water;

a cooling water tank provided downstream of said refrigerating cooler;

a temperature sensor for detecting an ambient air temperature;

a control section for selecting one of a joint use mode wherein both said air cooler and said refrigerating cooler are operated, and a single use mode wherein only said air cooler is operated with said refrigerating cooler stopped, according to said air temperature detected by said temperature sensor; and a cooling water processing element having at least one of a purifying filter, a strainer, and an ion exchange filter, wherein said cooling water circulating pump, said cooling water tank, said control section, and said cooling water processing element are set inside a room, while said air cooler and said refrigerating cooler are set outside said room.

18. A cooling apparatus for cooling circulated cooling water comprising:

a circulating pump for circulating the cooling water;

an outside air cooler serving as a first cooler, the outside air cooler including:

an outside air-water heat exchanger for exchanging heat between air and the cooling water;

a fan for passing the outside air onto the outside air-water heat exchanger; and a motor drivingly connected to the fan;

a refrigerating cooler serving as a second cooler, the refrigerating cooler including:

a refrigerating device having a refrigerant cycle; and a refrigerant-water heat exchanger for heat exchange between the cooling water and refrigerant cooled by the refrigerating device;

a cooling water tank provided on a downstream side of the second cooler;

an outside air temperature sensor for detecting an outside air temperature;

speed changing means for changing a speed of the motor of the outside air cooler;

a cooling water temperature sensor for detecting a cooling water temperature within the cooling water tank; and a control section for controlling the apparatus;

wherein the control section receives a signal from the outside air temperature sensor, and selects, according to the outside air temperature, one of a refrigerating-cooler joint use mode in which both the outside air cooler and the refrigerating cooler are driven, and an outside air cooler single use mode in which the refrigerating cooler is stopped; and wherein, during the outside air cooler single use mode, the control section receives a signal from the cooling water temperature sensor, and controls the speed changing means for the fan motor such that a rotation speed of the fan is controlled to keep the cooling water temperature at a predetermined value.

19. A cooling apparatus according to claim 18, wherein the temperature of said cooling water is 45 to 65° C. at an inlet to the cooling apparatus, and 20 to 40° C. at an outlet from the cooling apparatus, and a threshold temperature at which the refrigerating cooler is operated or stopped is 20 to 27° C.

20. A cooling apparatus according to claim 18, further comprising:

a filter including at least one of a cooling water purifying filter, strainer, and an ion exchange filter, wherein the cooling water circulating pump, the cooling water tank, the control section, and the filter are located inside a room, and the outside air cooler and the refrigerating cooler are located outside of the room.

21. A cooling apparatus according to claim 18, wherein the cooling water is used to cool a laser medium gas.

22. A cooling apparatus according to claim 18, further comprising:

a second fan for blowing the outside air onto a condenser included in the refrigerating device.

23. The cooling apparatus according to claim 18, wherein in the outside air cooler, the cooling water flows through a number of curved pipes arranged like needles of a needle point holder, and the cooling water is cooled by outside air removing heat from a surface outside of the pipes.

24. A cooling apparatus according to claim 23, wherein the pipes in the outside air cooler are made of copper.

25. A cooling apparatus for cooling circulated cooling water comprising:

a circulating pump for circulating the cooling water;

an outside air cooler serving as a first cooler, the outside air cooler including:

an outside air-water heat exchanger for exchanging heat between outside air and the cooling water;

a fan for passing the outside air onto the outside air-water heat exchanger; and a motor drivingly connected to the fan;

a refrigerating cooler serving as a second cooler, the refrigerating cooler including:

a refrigerating device having a refrigerant cycle; and a refrigerant-water heat exchanger for heat exchange between the cooling water and refrigerant cooled by the refrigerating device;

a cooling water tank provided on a downstream side of the second cooler;

an outside air temperature sensor for detecting an outside air temperature; and a control section which receives a signal from the outside air temperature sensor, and that selects, according to the outside air temperature, one of a refrigerator-cooler joint use mode in which both the outside air cooler and the refrigerating cooler are driven, and an outside air cooler single use mode in which only the outside air cooler is operated and the refrigerating cooler is stopped, wherein when the outside air temperature is 40° C., the outside air cooler is responsible for 60 to 74% of an entire cooling effect of said cooling apparatus, while the refrigerating cooler is responsible for 40 to 26% of the entire cooling effect of said cooling apparatus.

26. A cooling apparatus according to claim 25, wherein the temperature of said cooling water is 45 to 65° C. at an inlet to the cooling apparatus, and 20 to 40° C. at an outlet from the cooling apparatus, and a threshold temperature at which the refrigerating cooler is operated or stopped is 20 to 27° C.

27. A cooling apparatus according to claim 25, further comprising:

a filter including at least one of a cooling water purifying filter, strainer, and an ion exchange filter, wherein the cooling water circulating pump, the cooling water tank, the control section, and the filter are located inside a room, and the outside air cooler and the refrigerating cooler are located outside of the room.

28. A cooling apparatus according to claim 25, wherein the cooling water is used to cool a laser medium gas.

29. A cooling apparatus according to claim 25, further comprising:

a second fan for blowing the outside air onto a condenser included in the refrigerating device.

30. The cooling apparatus according to claim 25, wherein in the outside air cooler, the cooling water flows through a number of curved pipes arranged like needles of a needle point holder, and the cooling water is cooled by outside air removing heat from an outside surface of the pipes.

31. A cooling apparatus according to claim 30, wherein the pipes in the outside air cooler are made of copper.

32. A cooling apparatus for cooling circulated cooling water comprising:

a circulating pump for circulating the cooling water;

an outside air cooler serving as a first cooler, the outside air cooler including:

an outside air-water heat exchanger for exchanging heat between outside air and the cooling water;

a fan for passing the outside air onto the outside air-water heat exchanger; and a motor drivingly connected to the fan;

a refrigerating cooler serving as a second cooler, the refrigerating cooler including:

a refrigerating device having a refrigerant cycle and being driven by a compressor; and a refrigerant-water heat exchanger for heat exchange between the cooling water and refrigerant cooled by the refrigerating device;

a cooling water tank provided on a downstream side of the second cooler;

an outside air temperature sensor for detecting an outside air temperature; and a control section which receives a signal from the outside air temperature sensor, and that selects, according to the outside air temperature, one of a refrigerator-cooler joint use mode in which both the outside air cooler and the refrigerating cooler are driven, and an outside air cooler single use mode in which only the outside air cooler is operated and the refrigerating cooler is stopped, wherein when the outside air temperature is 40° C., a ratio in power consumption of the compressor in the refrigerating device relative to the fan of the outside air cooler is 2.5 to 3.5.

33. A cooling apparatus according to claim 32, wherein the temperature of said cooling water is 45 to 65° C. at an inlet to the cooling apparatus, and 20 to 40° C. at an outlet from the cooling apparatus, and a threshold temperature at which the refrigerating cooler is operated or stopped is 20 to 27° C.

34. A cooling apparatus according to claim 32, further comprising:

a filter including at least one of a cooling water purifying filter, strainer, and an ion exchange filter, wherein the cooling water circulating pump, the cooling water tank, the control section, and the filter are located inside a room, and the outside air cooler and the refrigerating cooler are located outside of the room.

35. A cooling apparatus according to claim 32, wherein the cooling water is used to cool a laser medium gas.

36. A cooling apparatus according to claim 32, further comprising:

a second fan for blowing the outside air onto a condenser included in the refrigerating device.

37. The cooling apparatus according to claim 32, wherein in the outside air cooler, the cooling water flows through a number of curved pipes arranged like needles of a needle point holder, and the cooling water is cooled by outside air removing heat from an outside surface of the pipes.

38. A cooling apparatus according to claim 37, wherein the pipes in the outside air cooler are made of copper.

* * * * *